US011668078B2

(12) United States Patent
Rogers

(10) Patent No.: US 11,668,078 B2
(45) Date of Patent: Jun. 6, 2023

(54) ADJUSTABLE PIT EXTENSION ASSEMBLY

(71) Applicant: The Ford Meter Box Company, Inc., Wabash, IN (US)

(72) Inventor: Rick Rogers, Wabash, IN (US)

(73) Assignee: The Ford Meter Box Company, Inc., Wabash, IN (US)

( * ) Notice: Subject to any disclaimer, the term of this patent is extended or adjusted under 35 U.S.C. 154(b) by 37 days.

(21) Appl. No.: 17/331,817

(22) Filed: May 27, 2021

(65) Prior Publication Data

US 2021/0372098 A1 Dec. 2, 2021

Related U.S. Application Data

(60) Provisional application No. 63/033,470, filed on Jun. 2, 2020.

(51) Int. Cl.
*E02D 29/12* (2006.01)
*E03B 7/09* (2006.01)

(52) U.S. Cl.
CPC ..... *E03B 7/095* (2013.01); *E02D 29/121* (2013.01)

(58) Field of Classification Search
CPC .... E02D 29/121; E02D 29/1409; E03B 7/095
(Continued)

(56) References Cited

U.S. PATENT DOCUMENTS 420,044 A * 1/1890 Dennis ..... E03B 9/08 220/3.7
520,542 A * 5/1894 Ryan ..... F16K 31/46 220/3.7

(Continued)

FOREIGN PATENT DOCUMENTS

CN 2218200 Y 1/1996
CN 2541519 Y 3/2003

(Continued)

OTHER PUBLICATIONS

McDonald Minute: Adjustable Meter Pit (https://www.youtube.com/watch?v=jxphAKarF8Y); Nov. 13, 2018.

(Continued)

*Primary Examiner* — Frederick L Lagman

(74) *Attorney, Agent, or Firm* — Barnes & Thornburg LLP

(57) ABSTRACT

A meter pit tile extension assembly is provided. Illustratively, an inner ring is attachable to a pit tile. The inner ring includes a first set of a plurality of outwardly extending ribs. A first space located adjacent the first set of the plurality of outwardly extending ribs. An outer ring is provided that is telescopingly positioned over, and vertically movable with respect to, the inner ring. The outer ring includes a first set of a plurality of inwardly extending ribs. The first set of the plurality of inwardly extending ribs of the outer ring are selectively positionable in a first position in the first space between the first set of the plurality of outwardly extending ribs. The outer ring is also rotatable with respect to the inner ring. Rotation of the outer ring with respect to the inner ring causes the first set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs.

20 Claims, 11 Drawing Sheets

(58) Field of Classification Search
USPC ..... 137/369, 370
See application file for complete search history.

(56) References Cited

U.S. PATENT DOCUMENTS

| | | | | |
|---|---|---|---|---|
| 2,099,479 | A * | 11/1937 | Heinkel | E03B 9/10 137/367 |
| 3,629,981 | A * | 12/1971 | McCaffery | E02D 29/1409 404/26 |
| 5,360,131 | A | 11/1994 | Phillipps et al. | |
| 6,036,401 | A | 3/2000 | Morina et al. | |
| 7,117,883 | B1 * | 10/2006 | Vitalo | E03B 9/08 137/367 |
| 9,032,989 | B2 | 5/2015 | Floyd et al. | |
| 9,243,944 | B2 | 1/2016 | Floyd et al. | |
| 9,664,301 | B2 * | 5/2017 | Grose | F16K 31/46 |
| 10,167,616 | B2 | 1/2019 | Floyd | |
| 2019/0194900 | A1 | 6/2019 | Aspen | |
| 2019/0330817 | A1 | 10/2019 | Levesque et al. | |

FOREIGN PATENT DOCUMENTS

| | | | |
|---|---|---|---|
| CN | 107034922 | A | 8/2017 |
| GB | 2337287 | A | 11/1999 |
| KR | 100925258 | B1 | 10/2009 |
| KR | 101686578 | B1 | 12/2016 |
| WO | WO-9116504 | A1 * | 10/1991 |

OTHER PUBLICATIONS

The Ford Meter Box Co. Inc.; Drawing of Barrel New Orleans Outer; Dated Feb. 10, 1972.
The Ford Meter Box Co. Inc.; Drawing of Barrel New Orleans Inner; Dated Feb. 10, 1972.
The Ford Meter Box Co.; The Crescent Meter Box Bulletin 112; Dated Jan. 15, 1922.
The Ford Meter Box Co. Inc.; Drawing of Proposed Meter Setting for New Orleans; Dated Oct. 17, 1920.
The Ford Meter Box Company, Inc. Manuel; Ford Meter Boxes/Section C; Dated Sep. 2014.
The Ford Meter Box Company, Inc.; Submittal Information—Crescent Box (CB111-xxx-NL style); Dated May 22, 2014.

* cited by examiner

ADJUSTABLE PIT EXTENSION ASSEMBLY

RELATED APPLICATIONS

The present Application relates to and claims priority to U.S. Provisional Patent Application, Ser. No. 63/033,470, filed on Jun. 2, 2020, entitled "Adjustable Pit Extension Assembly." The subject matter disclosed in that Provisional Application is hereby expressly incorporated into the present Application.

TECHNICAL FIELD AND SUMMARY

The present disclosure relates to waterworks pit tiles used to hold water meters or other waterworks devices below ground level, and particularly to a pit extension assembly that can selectively extend the height of the meter tile to accommodate a variety of pit depths.

In the waterworks industry, water meters are employed to track the volume of water passing from one point to another. Typically, these meters are placed underground below the frost line so they can operate in all weather conditions. Such meters (and other waterworks devices for that matter) are located within a vertically-oriented cylindrical tile that is located in a pit dug into the ground. The top of the tile is open and may be covered with a removable lid to allow the meter or other device to be read, inspected, or replaced. An issue with such pit tiles is that the ultimate depth of the pit tile to be installed may not be precisely known when obtaining parts to install the meter and tile. In some instances, the needed depth might be deeper than the length of the tile. In such instances, it may be advantageous to be able to extend the height of the pit tile.

Adjustable height of pit tiles are known in the art. For example, the Ford Meter Box crescent box includes telescoping inner and outer barrels that attach to an iron bottom. Outward extending threads on the inner barrel engage inward extending complementary threads formed on the inside of the outer barrel so that rotating the outer barrel with respect to the inner barrel translates into linear movement to extend the outer barrel to the necessary top surface grade.

An issue with any helically shaped cylindrical iron base is that the outer barrel does not lock relative to the inner barrel. This means the pit extension height may accidentally move (particularly, lower) after the correct height has been determined and other installation tasks such as backfilling the tiles are being attended to.

Accordingly, an illustrative embodiment of the present disclosure provides a meter pit tile extension assembly. The meter pit tile extension assembly includes an inner ring that is attachable to a pit tile. The inner ring includes a first set of a plurality of outwardly extending ribs and a second set of a plurality of outwardly extending ribs spaced apart from the first set of the plurality of outwardly extending ribs. The plurality of outwardly extending ribs of the first set of the plurality of outwardly extending ribs are each located substantially parallel to each other. The plurality of outwardly extending ribs of the second set of the plurality of outwardly extending ribs are each located substantially parallel to each other. A first space is located between the first set of the plurality of outwardly extending ribs and the second set of the plurality of outwardly extending ribs. A second space is located between the second set of the plurality of outwardly extending ribs and the first set of the plurality of outwardly extending ribs. The second space is spaced apart from the first space. An outer ring is also provided. The outer ring is telescopingly positioned over, and vertically movable with respect to, the inner ring. The outer ring includes a first set of a plurality of inwardly extending ribs and a second set of a plurality of inwardly extending ribs spaced apart from the first set of the plurality of inwardly extending ribs. The plurality of inwardly extending ribs of the first set of the plurality of inwardly extending ribs are each located substantially parallel to each other. The plurality of inwardly extending ribs of the second set of the plurality of inwardly extending ribs are each located substantially parallel to each other. The first set of the plurality of inwardly extending ribs of the outer ring are selectively positionable in a first position in the first space between the first set of the plurality of outwardly extending ribs and the second set of the plurality of outwardly extending ribs, and the second set of the plurality of inwardly extending ribs is located in the second space between the second set of the plurality of outwardly extending ribs and the first set of the plurality of outwardly extending ribs. The outer ring is also rotatable with respect to the inner ring. Rotation of the outer ring with respect to the inner ring causes the first set of the plurality of inwardly extending ribs and the second set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs and at least one inwardly extending rib of the second set of the plurality of inwardly extending ribs is selectively positionable adjacent at least one outwardly extending rib of the second set of the plurality of outwardly extending ribs. A tab is positioned adjacent at least one outwardly extending rib of the first set of the plurality of outwardly extending ribs and is engageable with an inwardly extending rib of the first set of the plurality of inwardly extending ribs. A stop tab is positioned adjacent the at least one outwardly extending rib of the first set of the plurality of outwardly extending ribs and is spaced apart from the tab that is positioned adjacent the at least one outwardly extending rib of the first set of the plurality of outwardly extending ribs. The tab that is positioned adjacent the at least one outwardly extending rib of the first set of the plurality of outwardly extending ribs inhibits the outer ring from being rotated in a first direction. Likewise, the stop tab that is positioned adjacent the at least one outwardly extending rib of the first set of the plurality of outwardly extending ribs inhibits the outer ring from being rotated in a second direction.

In the above and further embodiments, the meter pit tile extension assembly may further comprise: the inner ring further comprises a tab that is positioned adjacent the at least one outwardly extending rib of the second set of the plurality of outwardly extending ribs and is engageable with an inwardly extending rib of the second set of the plurality of inwardly extending ribs, and a stop tab is positioned adjacent the at least one outwardly extending rib of the second set of the plurality of outwardly extending ribs and is spaced apart from the tab that is positioned adjacent the at least one outwardly extending rib of the second set of the plurality of outwardly extending ribs, wherein the tab that is positioned adjacent the at least one outwardly extending rib of the second set of the plurality of outwardly extending ribs inhibits the outer ring from being rotated in the first direction, and wherein the stop tab that is positioned adjacent the at least one outwardly extending rib of the second set of the plurality of outwardly extending ribs inhibits the outer ring from being rotated in the second direction; the inner ring being configured to be attachable to an outer periphery of the pit tile; the inwardly extending rib of the first set of the plurality of inwardly extending ribs that is engageable with the tab is locatable adjacent the outwardly extending rib of the first set of the plurality of outwardly extending ribs between the tab and the stop tab; the inwardly extending rib of the second set of the plurality of inwardly extending ribs that is engageable with the tab is locatable adjacent the outwardly extending rib of the second set of the plurality of outwardly extending ribs between the tab and the stop tab; the stop tab prevents the outer ring from rotating more than about 90 degrees with respect to the inner ring; the second space located between the second set of the plurality of outwardly extending ribs and the first set of the plurality of outwardly extending ribs is positioned on an opposite side of the inner ring from the first space located between the first set of the plurality of outwardly extending ribs and the second set of the plurality of outwardly extending ribs; another inwardly extending rib of the first set of the plurality of inwardly extending ribs of the outer ring is locatable between a pair of outwardly extending ribs from the first set of the plurality of outwardly extending ribs of the inner ring; another inwardly extending rib of the second set of the plurality of inwardly extending ribs of the outer ring is locatable between a pair of outwardly extending ribs from the second set of the plurality of outwardly extending ribs of the inner ring; the tab that is positioned adjacent at least one outwardly extending rib of the first set of the plurality of outwardly extending ribs is resilient; the tab that is positioned adjacent at least one outwardly extending rib of the second set of the plurality of outwardly extending ribs is resilient; the outer ring that is vertically movable with respect to the inner ring does not use helical threads to translate rotational movement into linear movement to be vertically movable; the at least one outwardly extending rib of the first set of the plurality of outwardly extending ribs includes a chamfered edge located adjacent the tab; neither the first nor second sets of the plurality of outwardly extending ribs on the inner ring encircle an entire circumference of the inner ring; neither the first nor second sets of the plurality of inwardly extending ribs on the outer ring encircle an entire circumference of the outer ring.

Another illustrative embodiment of the present disclosure provides a meter pit tile extension assembly. An inner ring is attachable to a pit tile. The inner ring includes a first set of a plurality of outwardly extending ribs and a second set of a plurality of outwardly extending ribs spaced apart from the first set of the plurality of outwardly extending ribs. The plurality of outwardly extending ribs of the first set of the plurality of outwardly extending ribs are each located substantially parallel to each other. The plurality of outwardly extending ribs of the second set of the plurality of outwardly extending ribs are each located substantially parallel to each other. An outer ring is provided and is telescopingly positioned over, and vertically movable with respect to, the inner ring. The outer ring includes a first set of a plurality of inwardly extending ribs and a second set of a plurality of inwardly extending ribs spaced apart from the first set of the plurality of inwardly extending ribs. The plurality of inwardly extending ribs of the first set of the plurality of inwardly extending ribs are each located substantially parallel to each other. The plurality of inwardly extending ribs of the second set of the plurality of inwardly extending ribs are each located substantially parallel to each other. The outer ring is also rotatable with respect to the inner ring. Rotation of the outer ring with respect to the inner ring causes the first set of the plurality of inwardly extending ribs and the second set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs and at least one inwardly extending rib of the second set of the plurality of inwardly extending ribs is selectively positionable adjacent at least one outwardly extending rib of the second set of the plurality of outwardly extending ribs.

In the above and further embodiments, the meter pit tile extension assembly may further comprise: the inner ring includes a first space located between the first set of the plurality of outwardly extending ribs and the second set of the plurality of outwardly extending ribs, and a second space located between the second set of the plurality of outwardly extending ribs and the first set of the plurality of outwardly extending ribs, wherein the second space is spaced apart from the first space; the first set of the plurality of inwardly extending ribs of the outer ring are selectively positionable in a first position in the first space between the first set of the plurality of outwardly extending ribs and the second set of the plurality of outwardly extending ribs and the second set of the plurality of inwardly extending ribs is located in the second space between the second set of the plurality of outwardly extending ribs and the first set of the plurality of outwardly extending ribs; and the inner ring further includes a tab positioned adjacent at least one outwardly extending rib of the first set of the plurality of outwardly extending ribs and is engageable with an inwardly extending rib of the first set of the plurality of inwardly extending ribs, and a stop tab positioned adjacent the at least one outwardly extending rib of the first set of the plurality of outwardly extending ribs and is spaced apart from the tab that is positioned adjacent the at least one outwardly extending rib of the first set of the plurality of outwardly extending ribs, wherein the tab that is positioned adjacent the at least one outwardly extending rib of the first set of the plurality of outwardly extending ribs inhibits the outer ring from being rotated in a first direction; and wherein the stop tab that is positioned adjacent the at least one outwardly extending rib of the first set of the plurality of outwardly extending ribs inhibits the outer ring from being rotated in a second direction.

Another illustrative embodiment of the present disclosure provides a meter pit tile extension assembly. An inner ring is attachable to a pit tile. The inner ring includes a first set of a plurality of outwardly extending ribs. The plurality of outwardly extending ribs of the first set of the plurality of outwardly extending ribs are each located substantially parallel to each other. A first space located adjacent the first set of the plurality of outwardly extending ribs. An outer ring is provided that is telescopingly positioned over, and vertically movable with respect to, the inner ring. The outer ring includes a first set of a plurality of inwardly extending ribs. The plurality of inwardly extending ribs of the first set of the plurality of inwardly extending ribs are each located substantially parallel to each other. The first set of the plurality of inwardly extending ribs of the outer ring are selectively positionable in a first position in the first space between the first set of the plurality of outwardly extending ribs. The outer ring is also rotatable with respect to the inner ring. Rotation of the outer ring with respect to the inner ring causes the first set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs.

Additional features and advantages of the adjustable pit extension assembly will become apparent to those skilled in the art upon consideration of the following detailed descriptions of carrying out the adjustable pit extension assembly as presently perceived.

BRIEF DESCRIPTION OF THE DRAWINGS

The concepts described in the present disclosure are illustrated by way of example and not by way of limitation in the accompanying figures. For simplicity, and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Figure 2:
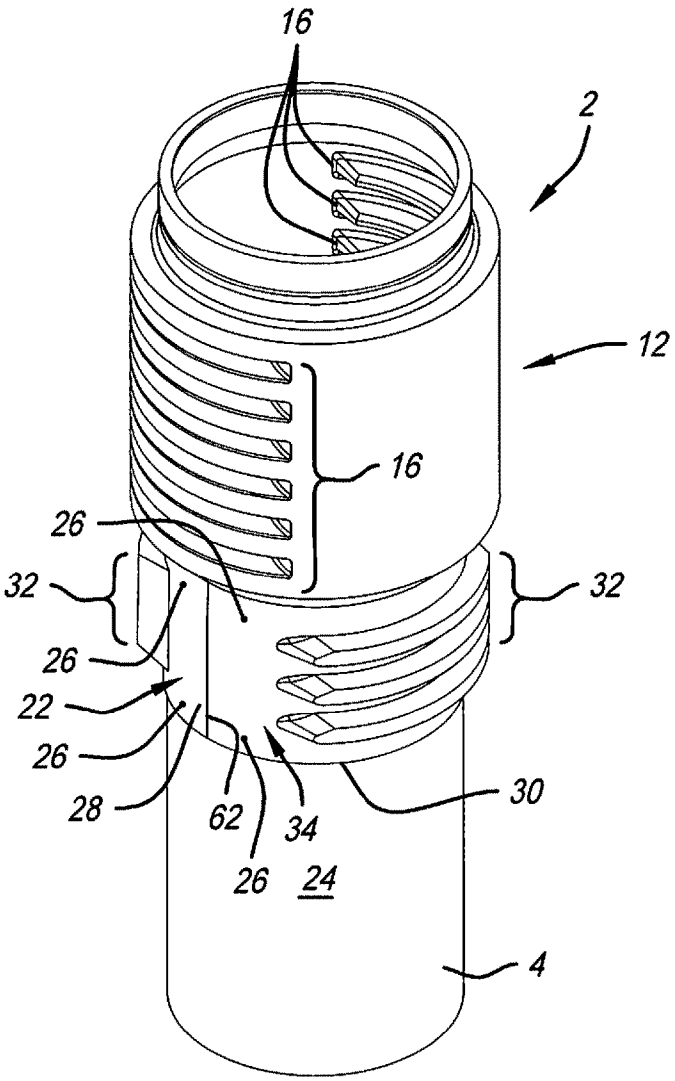
FIG. 2 is a partially exploded view of the meter pit extension assembly, including an inner ring assembly and an outer ring assembly.

Corresponding reference characters indicate corresponding parts throughout the several views. The exemplification set out herein illustrates embodiments of the adjustable pit extension assembly, and such exemplification is not to be construed as limiting the scope of the adjustable pit extension assembly in any manner.

DETAILED DESCRIPTION OF THE DRAWINGS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Accordingly, an illustrative embodiment of the present disclosure provides a meter pit tile extension assembly that can attach to the pit tile and extend the height of same to any variety of desired heights. Instead of a threaded crescent design, however, the adjustable pit extension assembly of the present disclosure provides an inner ring that attaches to the pit tile and has a series of outwardly extending ribs. An outer ring has complementary spaced apart inwardly directed ribs. Neither the inwardly or outwardly directed ribs encircle the entire circumference of either the outer or inner rings. Rather, the ribs, or sets of ribs are placed on opposing sides of the inner and outer rings. Illustratively, these rib sets may be placed about 180° from each other. This allows clearance for the outer ring to be lowered over the inner ring. When the desired height of the outer ring is determined relative to the pit tile, the outer ring is rotated about 90° to cause the inner ribs of the outer ring to engage the outer ribs of the inner ring at a fixed height.

In addition to setting the height, the ribs may include locking features to selectively hold the outer rib to the inner rib, thereby securing the inner and outer rings together. In an illustrative embodiment, the inner ribs may include a stop tab feature on their surfaces that allows the inner ribs of the outer ring to pass over and engage the outer ribs of the inner ring. Once the inner ribs have fully engaged the outer ribs by rotating the outer ring illustratively 90° with respect to the inner ring, the stop tab structure illustratively located on the surface of the inner ring blocks the inner ribs preventing same from rotating back in the opposite direction. The inner ring includes a positive stop structure that inhibits the outer ring from rotating past 90° by preventing the ribs from being able to rotate past each other. The net effect is that the inner and outer ribs are essentially secured to each other at this point, preventing the outer ring from moving with respect to the inner ring without substantial effort to overcome either the stop tab locking feature or the positive stop. At this point, further operations to complete installation of the pit tile may be performed, such as backfilling the pit tile, without risk of the outer ring dropping with respect to the inner ring and losing the desired grade height.

The present disclosure will be described hereafter with reference to the accompanying drawings which are given as non-limiting examples only.

Figure 1:
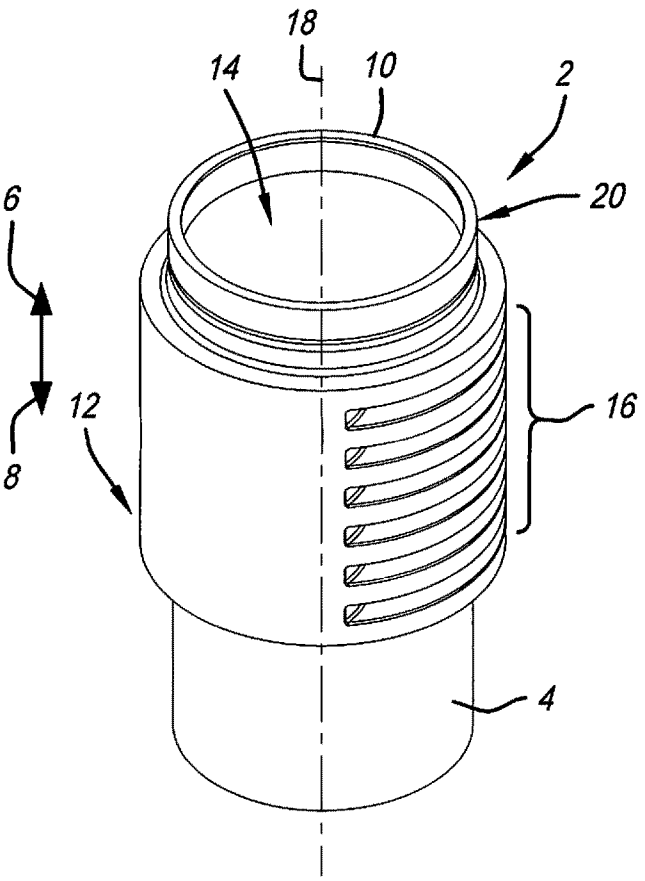
FIG. 1 is a perspective view of a meter pit extension assembly attached to a meter tile.

A perspective view of a meter pit extension assembly 2 attached to a meter tile 4 is shown in FIG. 1. It is appreciated that meter pit extension assembly 2 is movable illustratively vertically in directions 6 and 8 relative to meter tile 4 to extend the height of meter tile 4 as necessary to meet ground grade when meter tile 4 is installed in a pit. It will be appreciated by the skilled artisan upon reading this disclosure that the tile discussed herein, such as meter tile 4, may be sized and configured so that it can accommodate any meter or other device that needs to be located below ground level. Meter pit extension assemblies may be employed on those tiles or any other vertically-oriented ground tile that needs to be extended.

Further shown in FIG. 1 is rim 10, located at the illustrative uppermost extent of outer ring 12 of meter pit extension assembly 2. Rim 10 forms the outer periphery of bore 14 for providing access into meter tile 4. Typically, and as known in the art, a lid (not shown) may be coupled to rim 10 to cover bore 14.

In the illustrative embodiment, outer ring 12 may be a cylindrical structure of sufficient length to extend the vertical height of meter tile 4. As illustrated herein, a plurality of inwardly-directed ribs 16 are spaced apart and directed inwardly towards central axis 18 of meter tile 4 as illustratively shown. As further discussed herein, at least one of the plurality of inwardly-directed ribs 16 engage corresponding outwardly-directed ribs (see FIG. 2) to set an appropriate height beyond the height of meter tile 4.

As shown herein, the plurality of inwardly-directed ribs 16 do not extend around or encircle the entire circumference of outer ring 12. This is so that, as further discussed herein, outer ring 12 may be placed over meter tile 4 and movable vertically and freely thereto in order to acquire the desired height of top edge 20 of outer ring 12 above meter tile 4 to be at the appropriate grade level. Once the relative height between outer ring 12 and meter tile 4 is established, outer ring 12 may be rotated about central axis 18, in an illustrative embodiment about 90°, to set and secure outer ring 12 with respect to meter tile 4.

A partially exploded view of meter pit extension assembly 2 from meter tile 4 and an inner ring assembly 22 is shown in FIG. 2. Inner ring assembly 22 may illustratively be attached to the outer surface 24 of meter tile 4. Fasteners 26 may dispose through inner ring assembly 22 and into meter tile 4 in order to secure inner ring assembly 22 thereto. Also, illustratively, inner ring assembly 22 may be composed of cylindrical portions 28 and 30 separated by a seam 62 (see, also, FIG. 16A) allowing the inner ring assembly 22 to be wrapped around meter tile 4. It is appreciated that with regard to fasteners 26 that, alternatively, adhesives, rivets, or self-tapping screws or other connecting means may be employed to secure inner ring assembly 22 to meter tile 4. For ease of installation, cylindrical portions 28 and 30 of inner ring assembly 22 may be placed about outer surface 24 of meter tile 4 and then attached thereto via fasteners 26, or other like means, at any desired location in anticipation for receiving outer ring 12.

A plurality of outwardly-directed ribs 32 are illustratively parallelly spaced apart in separate sets. Each of the sets are placed on opposing sides of inner ring assembly 22 as demonstratively shown. Each of the plurality of outwardly-directed ribs are spaced apart in order to engage one or more of the plurality of inwardly-directed ribs 16 of outer ring 12. It is appreciated, as shown, that between opposing sets of the outwardly-directed ribs 32 is a channel 34. In order for outer ring 12 to fit over both inner ring assembly 22 and meter tile 4, the plurality of inwardly-directed ribs 16 cannot interfere with the plurality of outwardly-directed ribs 32. Channel 34 may be located on each side of inner ring assembly 22 between opposingly-positioned sets of outwardly-directed ribs 32. As shown in FIG. 2, because of the illustratively cylindrical character of outer ring 12, its sets of opposed pluralities of inwardly-directed ribs 16 are positioned adjacent channels 34 of inner ring assembly 22 so that outer ring 12 may be lowered in direction 8 and receive inner ring assembly 22 as part of the installation process of meter pit extension assembly 2.

Figure 3:
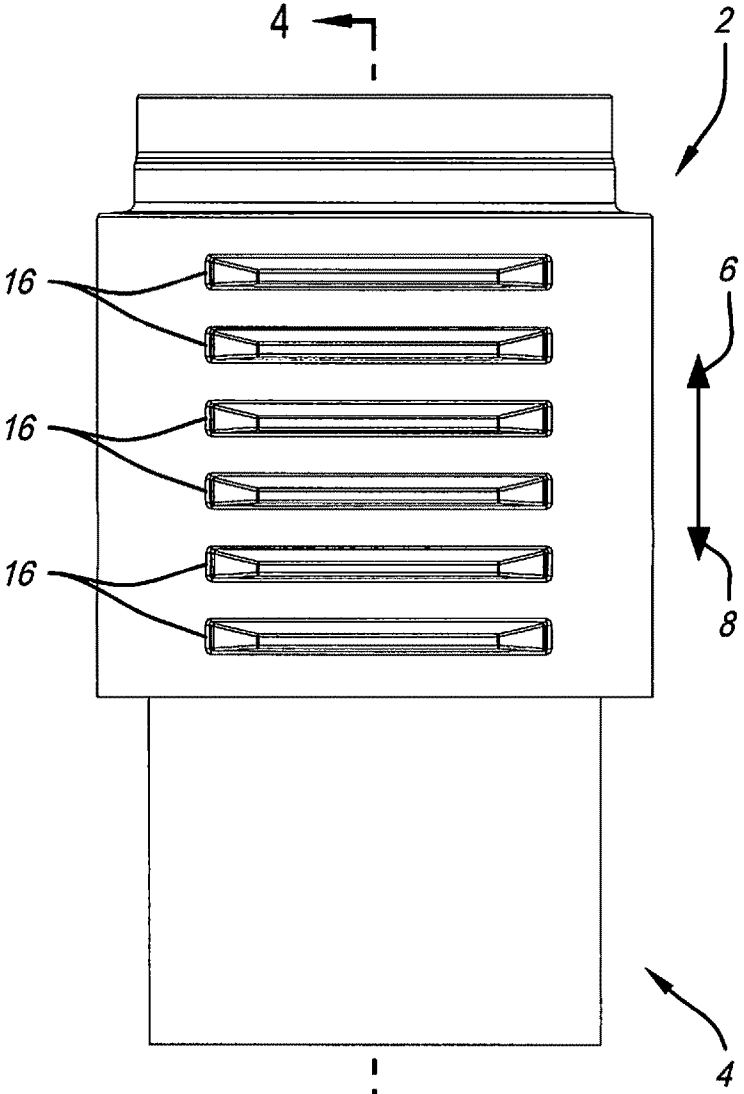
FIG. 3 is a side elevational view of the meter pit extension assembly located over the meter tile in an unlocked position.

A side elevational view of meter pit extension assembly 2 located over meter tile 4 is shown in FIG. 3. With outer ring 12 telescopingly positioned over meter tile 4, it can be appreciated how outer ring 12 may be movable in either directions 6 or 8 to adjust the total height of meter tile 4 with meter pit extension assembly 2 coupled thereto.

Figure 4:
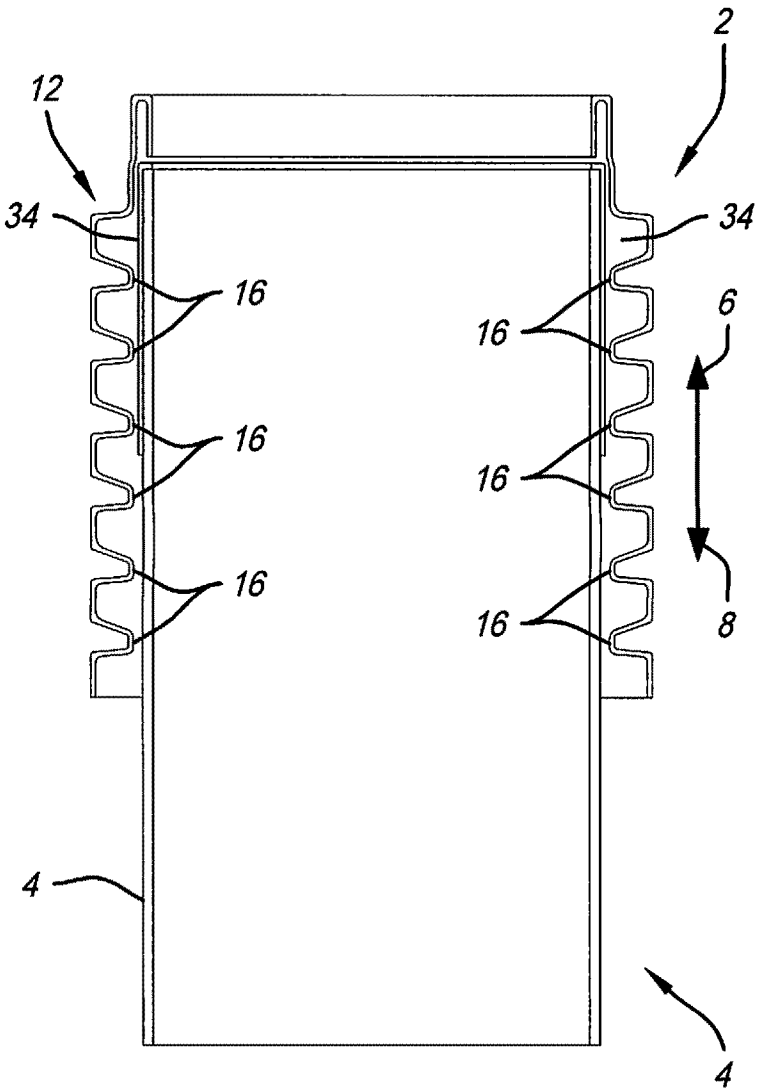
FIG. 4 is a cross-sectional elevational view of the meter pit extension assembly and meter tile taken along lines 4-4 of FIG. 3 in an unlocked position.

A cross-sectional elevational view of meter pit extension assembly 2 and meter tile 4, taken along lines A-A of FIG. 3, is shown in FIG. 4. This view assists in demonstrating how outer ring 12 is fitted over inner ring assembly 22 and meter tile 4. Here, inwardly directed ribs 16 are located in opposed channels 34 of inner ring assembly 22. As such, ribs 16 of outer ring 12 do not interfere with ribs 32 of inner ring assembly 22, while outer ring 12 is being moved in directions 6 or 8. This is useful as the lack of interference between ribs 16 and 32 allows for adjustment of outer ring 12 vertically with respect to meter tile 4 to obtain the necessary height with respect to meter tile 4. It will be appreciated by the skilled artisan upon reading this disclosure that vertical adjustment of outer ring 12 is not contingent on engagement of helical threads located on each of the outer ring and inner ring to translate that rotational movement into linear movement. Instead, all that is employed is vertically linear movement of outer ring 12 with respect to meter tile 4 in order to obtain a desired height of meter pit extension assembly 2 with respect meter tile 4. To that end, ribs 16 on outer ring 12 and ribs 32 on inner ring assembly 22 are not helical and, thus, each do not need to be wrapped around the entire circumference of the structures. Thus, ribs 16 of outer ring 12 located in channel 34 of inner ring assembly 22 and ribs 32 located in channel 36 of outer ring 12 (see, also, FIG. 6) permit free vertical adjustment in directions 6 and 8 of outer ring 12 until the desired height above meter tile 4 is achieved.

Figure 6:
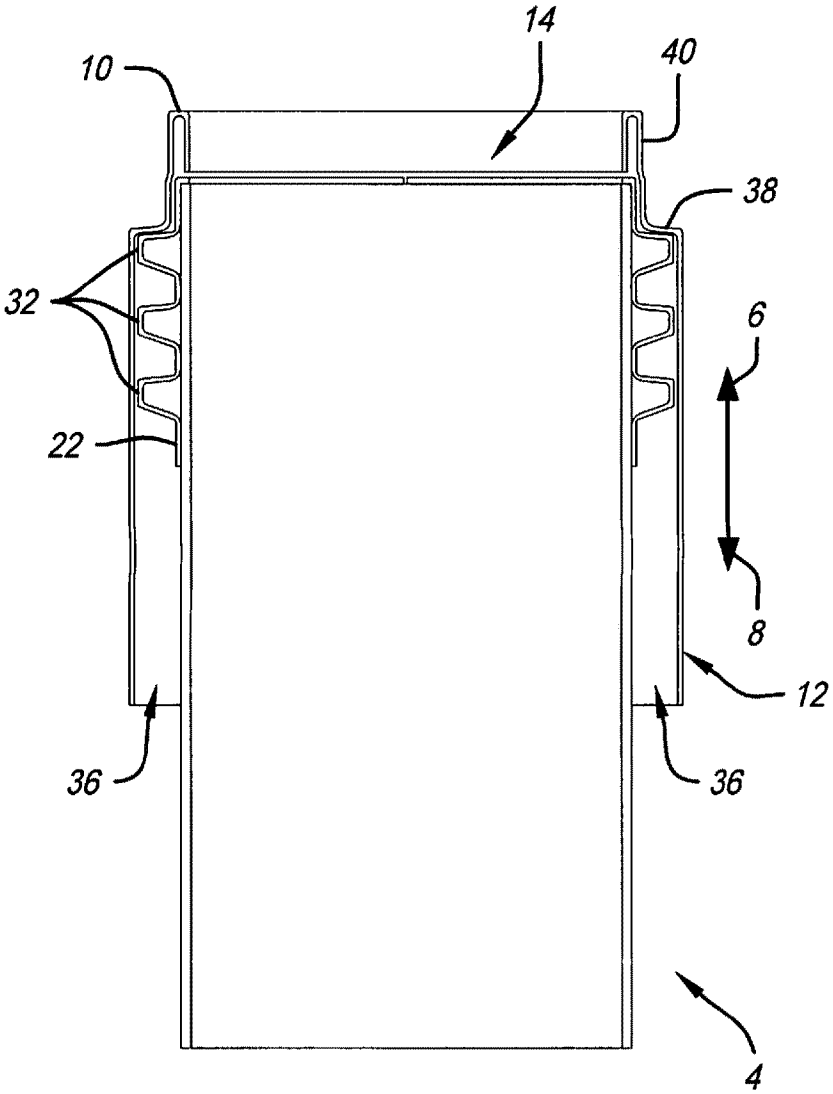
FIG. 6 is a cross-sectional elevational view of the meter pit extension assembly and meter tile taken along lines 6-6 of FIG. 5 in an unlocked position.
Figure 5:
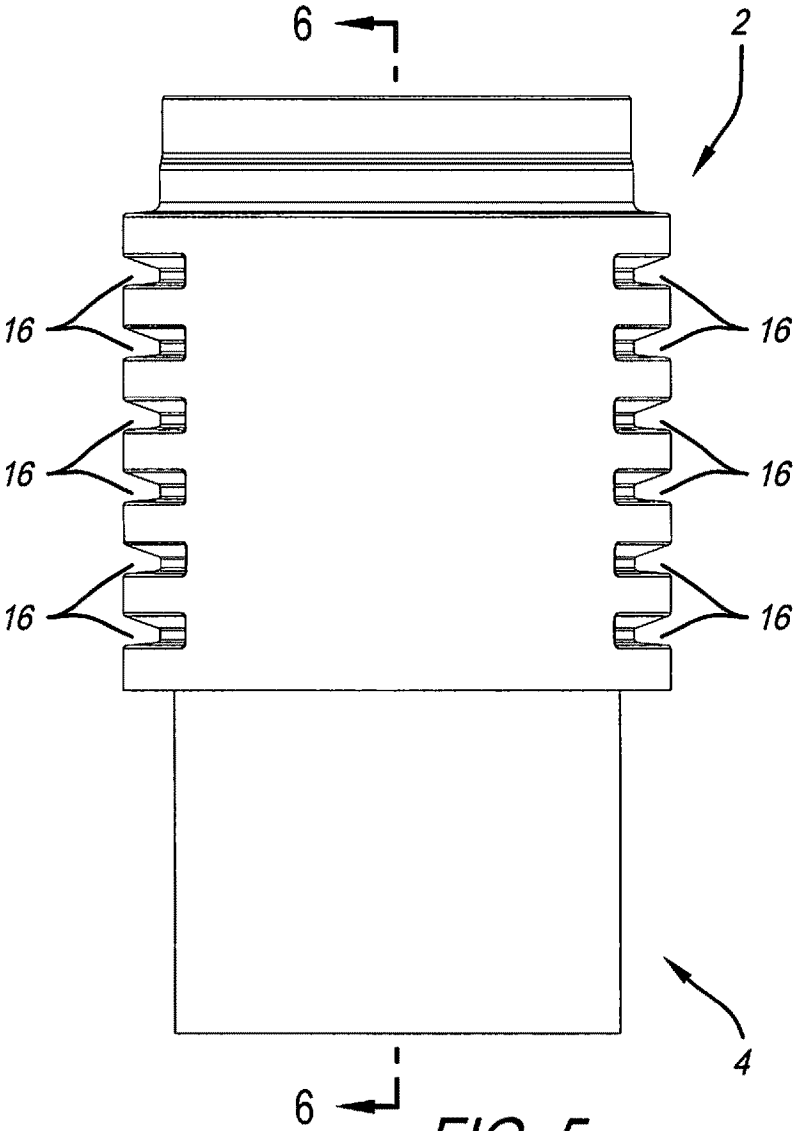
FIG. 5 is another side elevational view of the meter pit assembly located over the meter tile in an unlocked position.

A side elevational view of meter pit extension assembly 2 located over meter tile 4, similar to that shown in FIG. 3, is shown in FIG. 5. This view, however, is taken at about a 90° rotational shift from that shown in FIG. 3. The view in FIG. 5 depicts how the plurality of inwardly-directed ribs 16 are located on each side of outer ring 12, but do not encircle the entire periphery of outer ring 12. Instead, a space exists on outer ring 12 between each of the plurality of the inwardly-directed ribs 16 as shown. Such space is utilized as shown in the cross-sectional view taken along lines B-B of FIG. 5 in FIG. 6. Between the opposing pluralities of inwardly-directed ribs 16 on outer ring 12 are channels 36. These channels 36 are formed in the interior of outer ring 12 at bore 14 and are bounded by the pluralities of inwardly-directed ribs 16 as shown in FIG. 6. The plurality of outwardly-directed ribs 32 of inner ring assembly 22 fit in channels 36 allowing unobstructed movement of outer ring 12 in directions 6 and 8 relative to meter tile 4 and inner ring assembly 22.

Again, these views in FIGS. 3, 4, 5, and 6, demonstrate the convenience of moving outer ring 12 with respect to meter tile 4 by moving outer ring 12 in vertical directions 6 and 8 until the desired grade height is reached. This is in contrast to having to rotate an outer ring along a helical thread in order to translate rotational movement into vertical movement. Here, it is a simple vertical movement up and down to set outer ring 12 to the desired height. Thus, by the plurality of inwardly-directed ribs 16 located in channel 34 of inner ring assembly 22 and the plurality of outwardly-directed ribs 32 located in channel 36 of outer ring 12, the same is free to move vertically without obstruction. Also shown in this view is ledge 38, which illustratively reduces the diameter of outer ring 12 at collar 40 terminating at rim 10. Ledge 38 has a utility of engaging one of the plurality of outwardly-directed ribs 32. This allows outer ring 12 to rest on inner ring assembly 22, as shown herein prior to vertical adjustment of outer ring 12.

Figure 8:
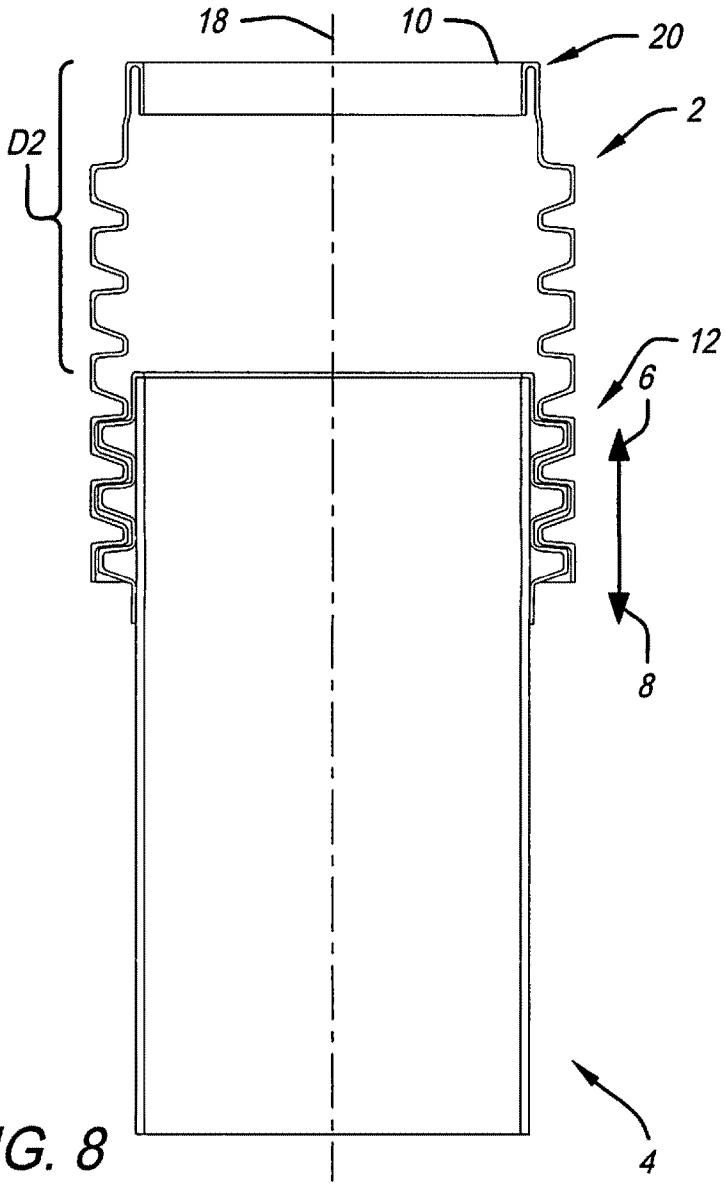
FIG. 8 is another cross-sectional elevational view of the meter pit extension assembly positioned on the meter tile tile in a locked position.
Figure 7:
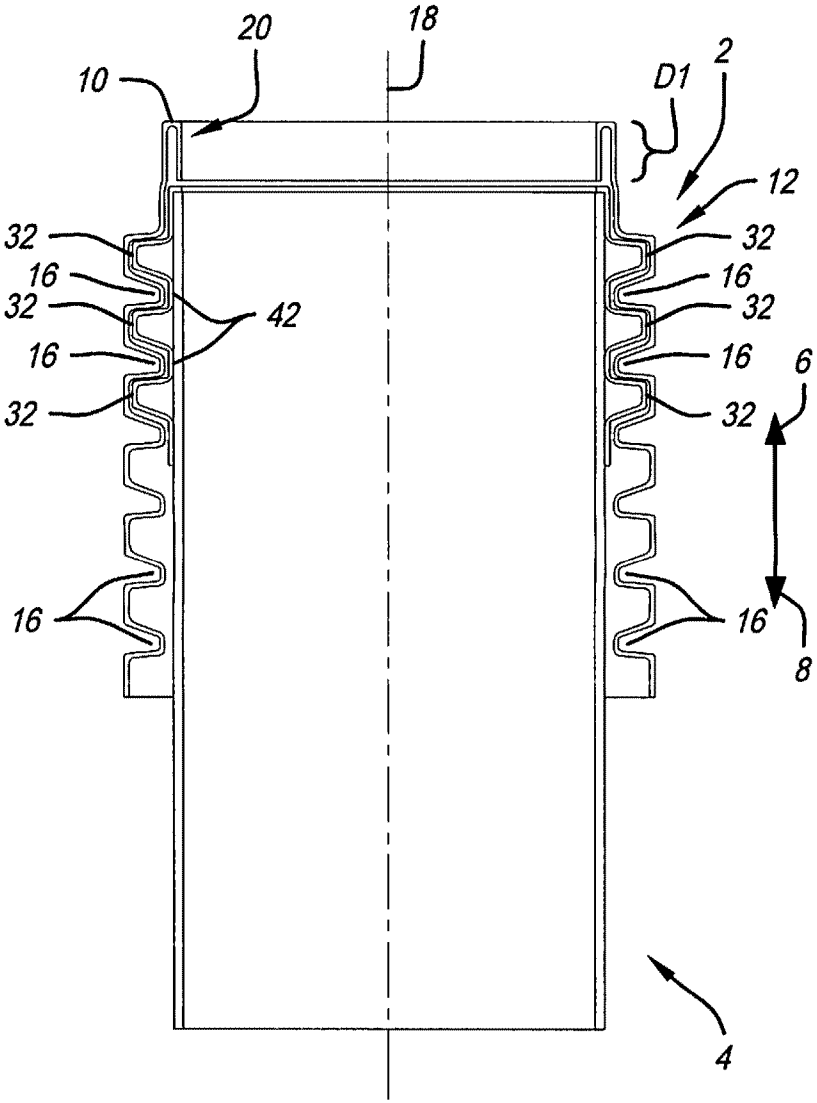
FIG. 7 is a cross-sectional elevational view of the meter pit extension assembly positioned on the meter tile in a locked position.

Cross-sectional elevational views of meter pit extension assembly 2 positioned on meter tile 4 are shown in FIGS. 7 and 8. These two views demonstrate how outer ring 12 may be moved in either directions, 6 or 8 to constructively extend the height of meter tile 4. As shown, for example, in FIG. 7, inwardly-directed ribs 16 of outer ring 12 are shown fitted in corresponding slots 42 of inner ring assembly 22 between adjacent outwardly-directed ribs 32.

The view shown in FIG. 7 is such that top edge 20 of rim 10 extends a height above meter tile 4 indicated by a distance D1, which is a minimal height. As shown, D1 is illustratively the least distance that top edge 20 of outer ring 12 sits above meter tile 4. This is in contrast to the view of meter pit extension assembly 2 shown in FIG. 8 wherein top edge 20 of rim 10 is positioned above meter tile 4, a distance D2. It will be appreciated by the skilled artisan upon reading this disclosure that the distance top edge 20 may sit above meter tile 4 can be any distance above D2 or between D1 and D2, where at least one inwardly-directed ribs 16 engages at least one outwardly-directed ribs 32. Hence, each of outer ring 12 and inner ring assembly 22 include pluralities of inwardly directed ribs 16 and outwardly directed ribs 32, respectively, in spaced-apart and stacked configuration such as that shown in the figures. This allows outer ring 12 to engage and secure to inner ring assembly 22 at any of a variety of heights above meter tile 4.

Additionally, and as further shown herein, securement between ribs 16 on outer ring 12 and ribs 32 extending from inner ring assembly 22, engage each other by rotating outer ring 12 with respect to inner ring assembly 22 about central axis 18 about ¼ turn or about 90 degrees from the positions shown in FIGS. 3, 4, 5, 6. In other words, outer ring 12 may be moved vertically in directions 6 or 8. When positioned as that shown in FIGS. 3, 4, 5, and 6, ribs 16 do not engage ribs 32. Once the desired height of outer ring 12 above meter tile 4 is established (such as D1, D2, or other height), outer ring 12 is rotated about central axis 18 about ¼ turn so that at least one of the inwardly-directed ribs 16 is positioned in a slot 42 at least adjacent outwardly-directed rib or ribs 32 to secure outer ring 12 to inner ring assembly 22.

Figure 16B:
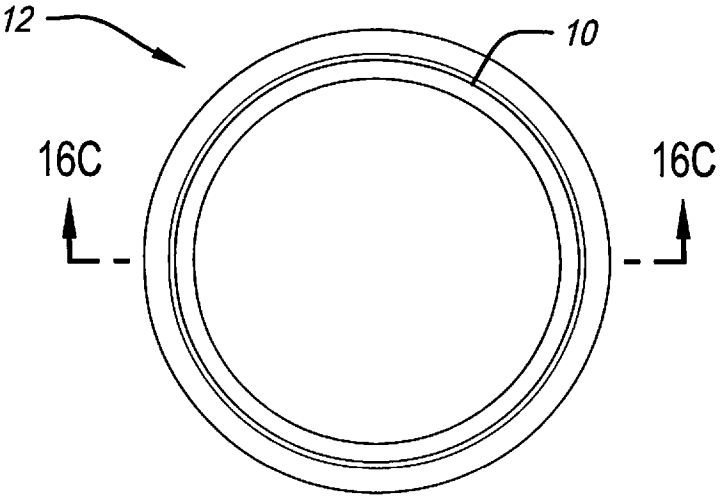
FIGS. 16A, 16B, 16C, 16D, and 16E are perspective, top, side cross-sectional, and multiple side views of the outer ring.
Figure 16A:
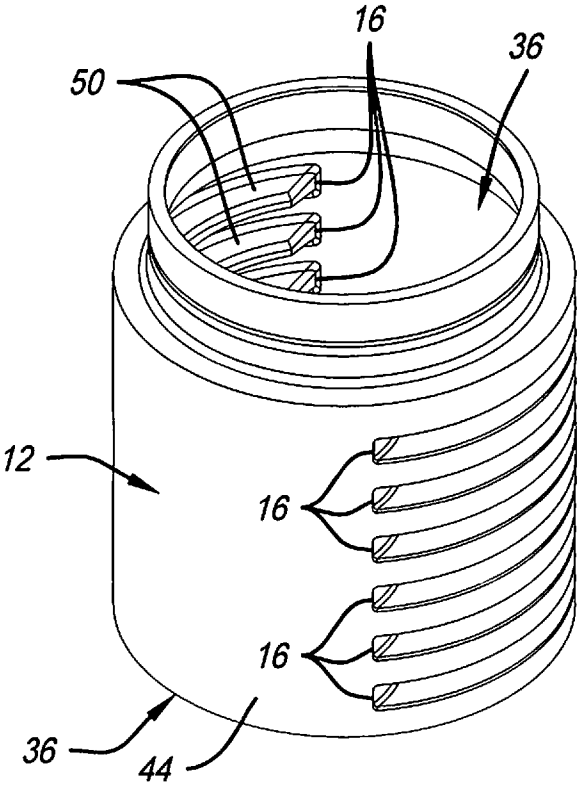
Figure 17B:
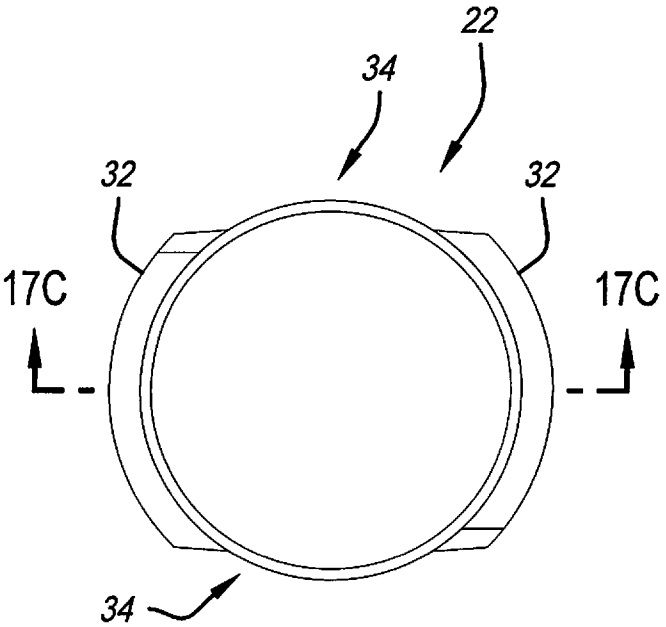
FIGS. 17A, 17B, 17C, 17D, and 17E are perspective, top, side cross-sectional, and multiple side views of the inner ring.
Figure 17A:
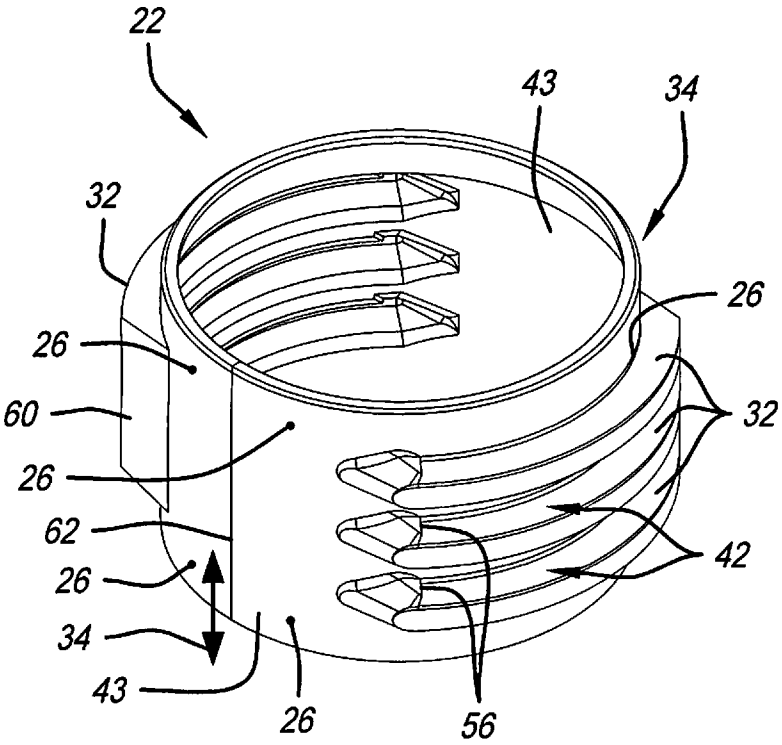
Figure 17E:
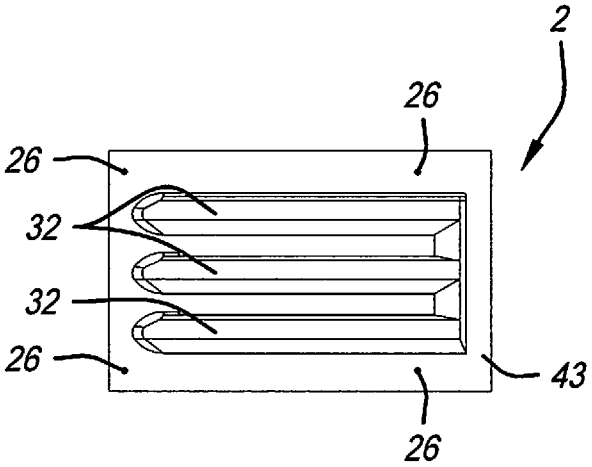
Figure 17D:
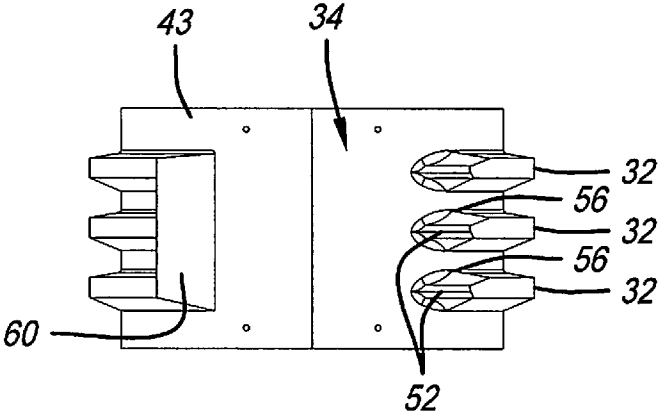
Figure 17C:
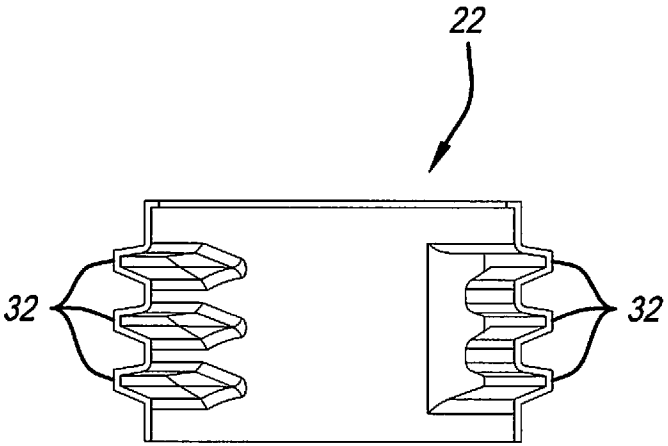

Perspective partial-cutaway and detail views of meter pit extension assembly 2 located over meter tile 4 and rotated into a locked position, are shown in FIGS. 9, 10, 11, 12, 13, 14, and 15. In the perspective view of FIG. 9, a portion of body 44 of outer ring 12 is ghosted to show the plurality of inwardly-directed ribs 16 as at least some of them begin to engage corresponding outwardly-directed ribs 32 on inner ring assembly 22 at slots 42. It is appreciated that ribs 16 are rotated in direction 46, in this case counterclockwise, in order to move into slots 42 and engage corresponding ribs 32. It is further appreciated, however, that alternatively, meter pit extension assembly 2 may be configured differently along with ribs 16 and ribs 32 so that rotating outer ring 12 in an opposite direction 48 about central axis 18 may couple outer ring 12 and inner ring assembly 22 together. It is further appreciated that engagement surfaces of either or both of ribs 16 and 32 may be chamfered in order to make engagement and positioning at least one rib 16 into slot 42 easier. Chamfered surfaces provide tolerance when rotating outer ring 12 about central axis 18 to help direct rib 16 into slot 42 between or at least adjacent rib or ribs 32. Examples of chamfered surfaces such as chamfered surface 50 on rib 16, is shown in FIG. 16A, and chamfered surface 52 on rib 32 of inner ring assembly 22 is shown in FIG. 17A. Such chamfered surfaces will make it easier for an operator to rotate outer ring 12 with respect to meter tile 4 to secure same with inner ring assembly 22 in order to maintain meter pit extension assembly 2 at its desired position over meter tile 4.

Figure 10:
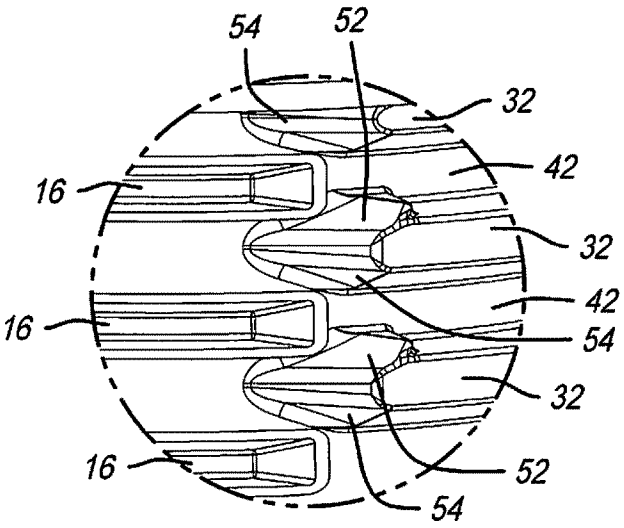
FIG. 10 is a perspective partial-cutaway detail view of a portion of the meter pit extension assembly from FIG. 9 in the start of engagement to a locked position.
Figure 9:
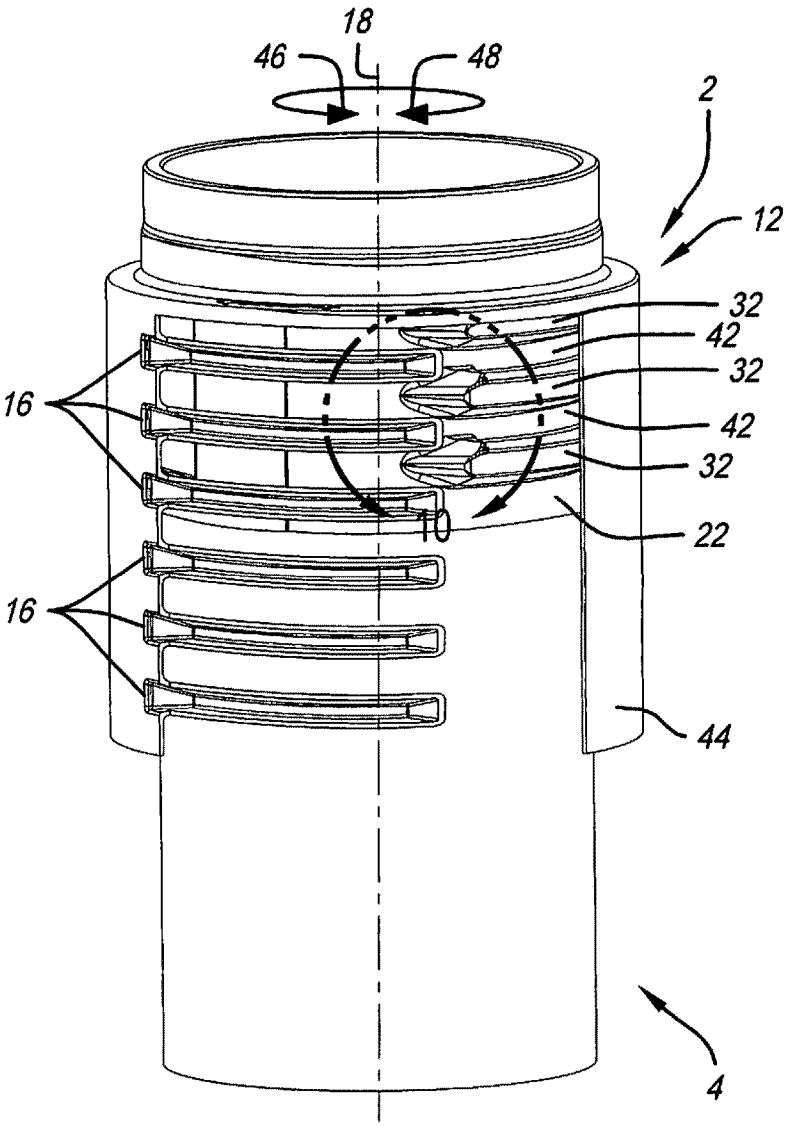
FIG. 9 is a perspective partial-cutaway view of the meter pit extension assembly located on a meter tile in a start of engagement to a locked position.

The detail view of ribs 16 starting to engage rib 32 of FIG. 9 is shown in FIG. 10. As shown, ribs 16 are aligned with slots 42 between ribs 32. Chamfered surface 52 on each rib 32 are also shown. An additional chamfered surface 54 may be positioned on rib 32 opposite chamfered surface 52 creating an arrow-like structure to further assist directing rib 16 into slot 42.

Figure 12:
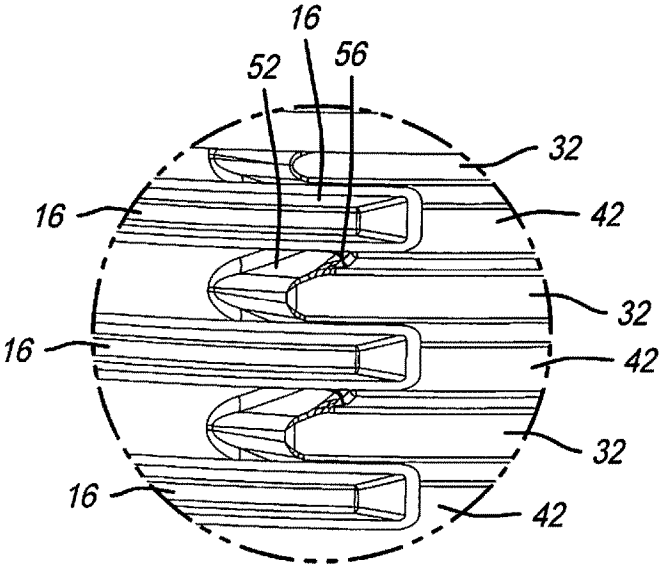
FIG. 12 is a perspective partial-cutaway detail view of a portion of the meter pit extension assembly from FIG. 11 in a partially locked position.
Figure 11:
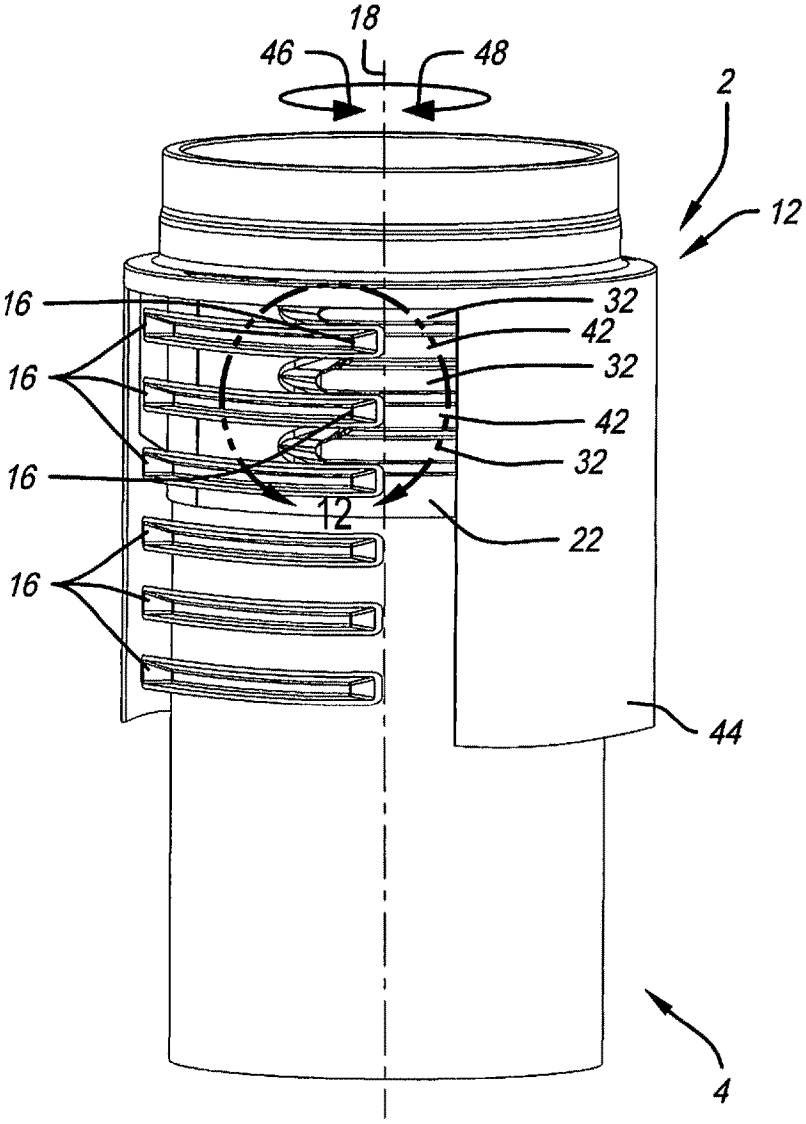
FIG. 11 is another perspective partial-cutaway view of the meter pit extension assembly located on a meter tile in a partially locked position.

Partial cut away and detail views of meter pit extension assembly 2 located on meter tile 4 are shown in FIGS. 11 and 12, respectively. These views are similar to that shown in FIGS. 9 and 10, except that outer ring 12 has now been rotated further in direction 46 to continue the coupling process of outer ring 12 onto inner ring assembly 22. As shown in both FIGS. 11 and 12, ribs 16 are further positioned in respective slots 42 between adjacent ribs 32. It is appreciated that despite the shown ribs 16 disposed in slots 42, any of the ribs 16 may be positioned in any of the slots 42 as desired to maintain a desired height of outer ring 12 above meter tile 4.

As particularly shown in the detail view of FIG. 12, ribs 16 are moved past chamfered surface 52. A stop tab 56 extends from chamfered surface 52 on rib 32 as illustratively shown. As further discussed with respect to FIGS. 13 and 14, stop tab 56 extends from both chamfered surface 52 and rib 32. Illustratively, because of the angle of stop tab 56 above chamfered surface 52 and rib 32, ribs 16 moving in direction 46, passes there over without significant obstruction. In some embodiments, stop tab 56 may serve as a gap filler that biases rib 16 against an adjacent rib 32 to provide smooth movement of outer ring 12 as ribs 16 is further disposed in slot 42. A purpose of stop tab 56 is to prevent ribs 16 from inadvertently moving backward in direction 48, after they have been fully set in corresponding slots 42 as further shown in FIGS. 13, 14, and 15. This is so that once outer ring 12 is set with respect to inner ring assembly 22 by rotating ribs 16 into corresponding slots 42 between ribs 32, outer ring 12 will be securely set with respect to inner ring assembly 20 to a desired height above meter tile 4.

Figure 14:
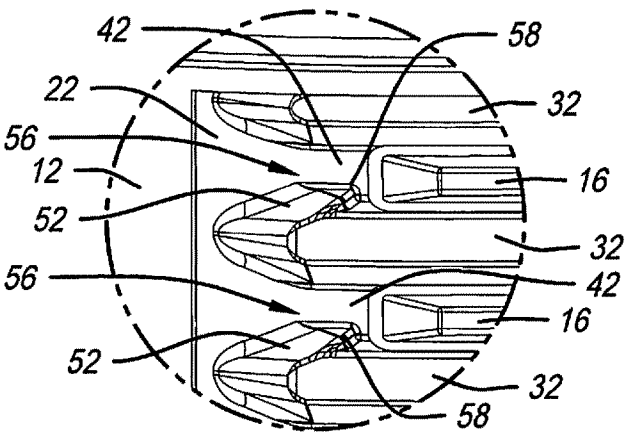
FIG. 14 is a perspective partial-cutaway detail view of a portion of the meter pit extension assembly from FIG. 13 in a locked position.
Figure 15:
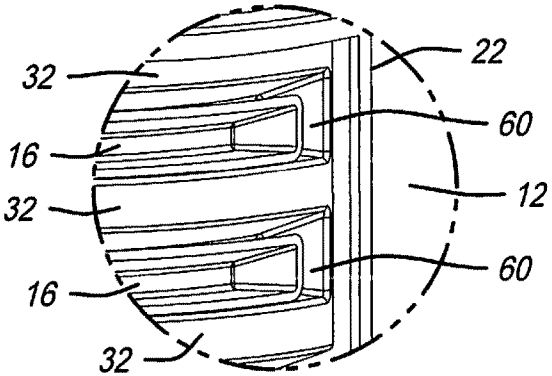
FIG. 15 is another perspective partial-cutaway detail view of a portion of the meter pit extension assembly from FIG. 13 in a locked position.
Figure 13:
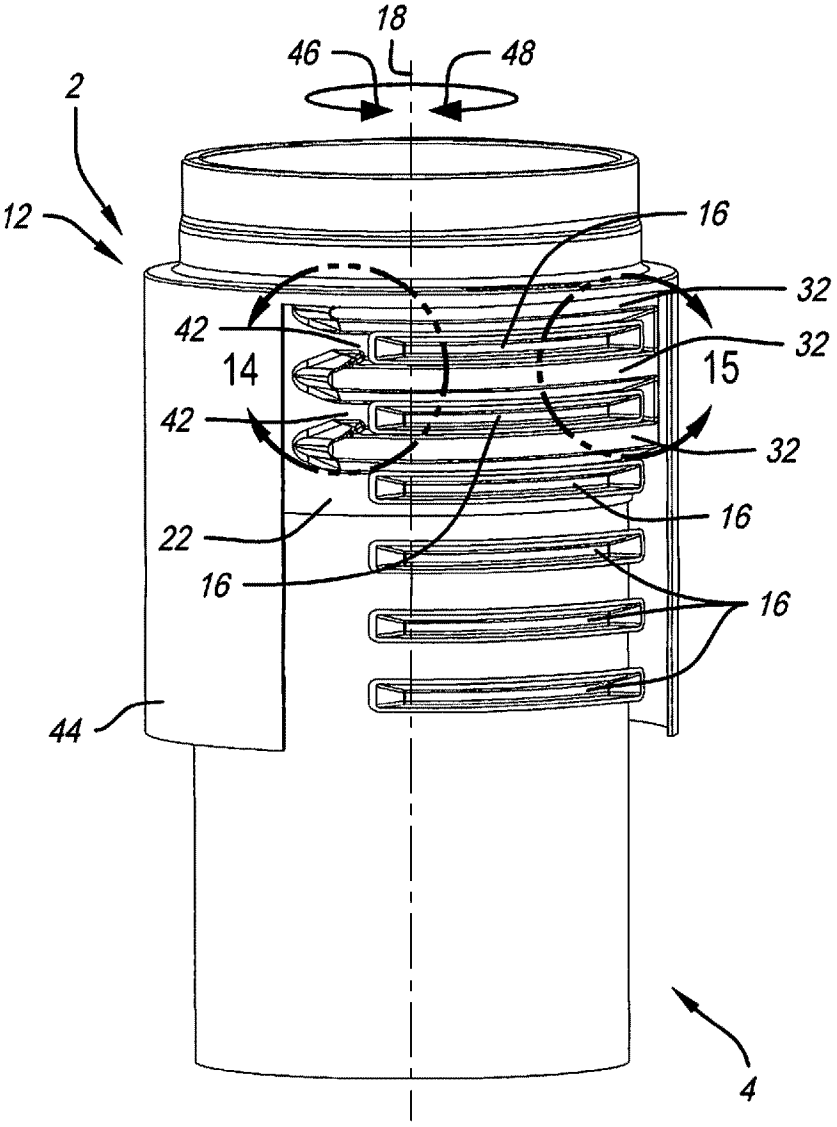
FIG. 13 is another perspective partial-cutaway view of the meter pit extension assembly located on a meter tile in a locked position.

Partially cut away perspective and detail views of meter pit extension assembly 2 connected to meter tile 4 via outer ring 12 and inner ring assembly 22, are shown in FIGS. 13, 14, and 15. The partially cut away perspective view of FIG. 13 shows outer ring 12 further rotated in direction 46 so that ribs 16 are fully positioned within slots 42 adjacent at least one rib 32 or between adjacent ribs 32. In these views, outer ring 12 is fully engaged on and coupled to inner ring assembly 22. With outer ring 12 in the position shown, it is being fully supported by ribs 32 of inner ring assembly 22, thereby holding inner ring 12 some distance above meter tile 4. It is appreciated that the position of outer ring 12 shown with respect to inner ring assembly 22 and meter tile 4 is illustrative. A skilled artisan upon reading this disclosure will appreciate that any of the plurality of inwardly-directed ribs 16 may engage corresponding outwardly-directed ribs 32 so as to secure outer ring 12 any height, whether D1, D2 (see, also, FIGS. 7 and 8), or any other heights above meter tile 4. The positions shown herein are for demonstrative purposes only.

Illustratively, when a ribs 16 area fully rotated, illustratively in direction 46 adjacent ribs 32, ribs 16 are located in a secure or locked position with respect to rib 32, as demonstrated by the views shown in FIGS. 14 and 15. After a rib 16 has fully passed stop tab 56 extending from chamfered surface 52 at the edge of rib 32, rib 16 is prevented from moving backward, illustratively, in direction 48 to move out from slot 42. The reason is that because stop tab 56 essentially extends chamfered surface 52, stop tab 56 continues the grade of chamfered surface 52. Additionally, stop tab 56 is resilient in that it may be moved downward as rib 16 passes over top. Once rib 16 is cleared of stop tab 56, however, it moves back to its original position. Once that happens, because stop tab 56 does not have a ramp in the opposite direction, but rather a stop edge 58 (i.e., the trailing edge of stop tab 56), if ribs 16 are moved in direction 48, stop edge 58 serves as a barrier to prevent rib 16 from moving backward past stop tab 56.

At the other end of slot 42, between adjacent ribs 32, and opposite from stop tab 56, is a positive stop 60 that serves as a barrier to ribs 16. Positive stop 60 prevents ribs 16 from being able to rotate past the end of ribs 32 opposite stop tab 56. This means that each of ribs 32, based on the height of outer ring 12 above inner ring assembly 22 and/or meter tile 4, is essentially locked between stop edge 58 and positive stop 60. Accordingly, there is little risk of outer ring 12 moving in directions 46 or 48 to unintentionally extricate itself from engagement with inner ring assembly 22, where outer ring 12 may accidentally fall in direction 8, thereby losing its set height above meter tile 4. Outer ring 12 is, thus, locked in position allowing installers to attend to other tasks without concern for outer ring 12 moving inadvertently.

Illustratively, it may be possible to extricate ribs 16 from slots 42 by exerting a substantial force when attempting to rotate outer ring 12 in direction 48. The force to accomplish this, however, must be sufficient to overcome stop edge 58 of stop tab 56. Although this may be conceivably done, it is contemplated that it will only be successful upon a purposeful effort in rotating outer ring 12 in direction 48 indicative of intentional movement to unlock outer ring 12 from inner ring assembly 22.

Perspective, top, side cross-sectional, and multiple side views of outer ring 12 are shown in FIGS. 16A, 16B, 16C, 16D, and 16E. The perspective view of outer ring 12 in FIG. 16A shows the spaced apart plurality of inwardly-directed ribs 16 along with channel 36 located between separate sets of inwardly-directed ribs 16. It is appreciated that each of the sets of inwardly-directed ribs are spaced apart between channels 36 such that outer ring 12 may be placed over inner ring assembly 22 and pass over same with separate sets of outwardly-directed ribs on inner ring assembly 22 located in channels 36, while the sets of inwardly-directed ribs 16 are located in channels 34 of inner ring assembly 22, thereby allowing outer ring 12 to telescopingly move vertically in either directions 6 or 8 with respect to inner ring assembly 22 freely without any interference. This allows, as previously discussed, easy movement of outer ring 12 with respect to inner ring assembly 22 for setting outer ring 12 at a desired height above meter tile 4.

Figure 16E:
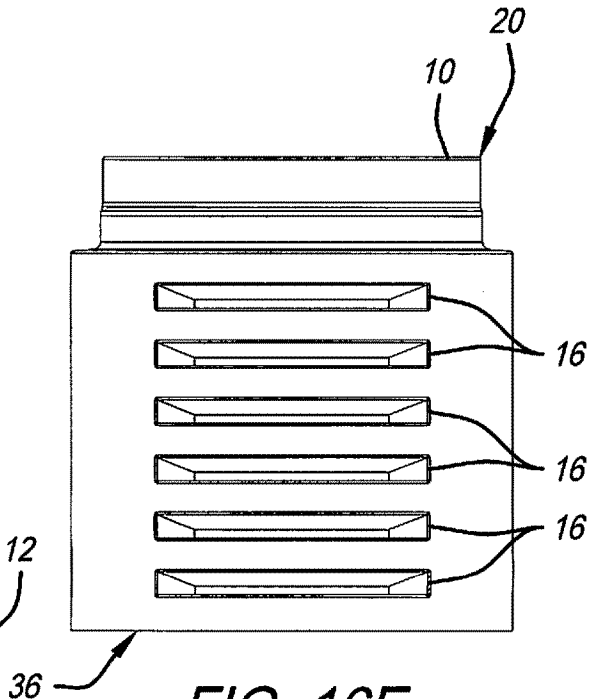
Figure 16D:
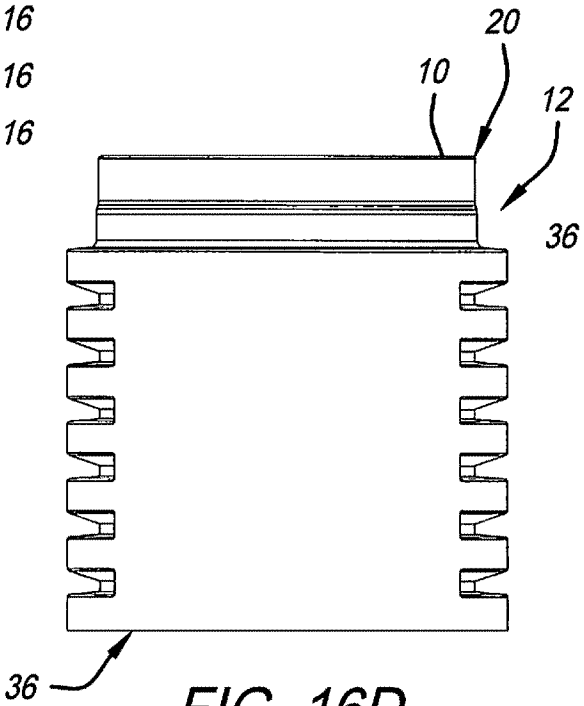
Figure 16C:
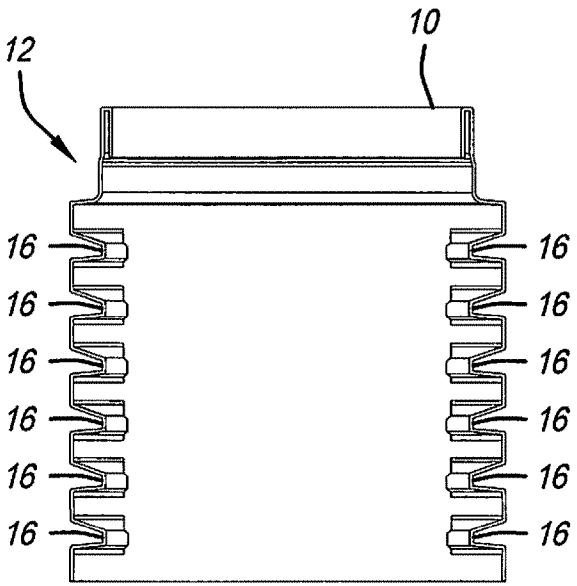

The views shown in FIGS. 16C, 16D, and 16E, for example, further demonstrate how the plurality of ribs are illustratively positioned about parallel with each other and have opposing sets with channels 36 located therebetween. These views also further illustrate rim 10 at top edge 20 sized to receive a lid (not shown) that might otherwise cover meter tile 4. Also, illustratively, each of the plurality of inwardly-extending ribs may have angled surfaces, as shown, sufficient to slide past outwardly-directed ribs 32 in slots 42, as previously shown herein.

Various perspective, top, cross-section elevational, and elevational views of inner ring assembly 22, are shown in FIGS. 17A, 17B, 17C, 17D, and 17E. The view shown in FIG. 17A further illustrates the plurality of outwardly-directed ribs 32 extending from body 43. This view also shows chamfered surfaces 52 located at the leading edge of the ribs 32 adjacent slots 42. Stop tabs 56 are also shown extended into respective slots 42. Stop 60 is shown located at the opposite side of the plurality of outwardly-directed ribs 32 from chamfered surface 52. Opposed channels 34 are shown formed by body 43 between opposing sets of outwardly-directed ribs 32 (see, also, FIGS. 17B and 17D).

These views also depict inner ring assembly 22 as a single piece structure that is cut longitudinally along seem 62 so as to be able to wrap around meter tile 4 as shown in the other views. Fasteners 26 may then be inserted through body 43 (or through pilot holes) to secure inner ring assembly 22 onto meter tile 4. It is further appreciated that any dimensions are illustrative and provided herein for demonstrative purposes. One skilled in the art will appreciate from reading this disclosure that the outer ring 12 and inner ring assembly 22 may be differently dimensioned to accommodate meter tiles having any variety of sizes.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that, to the extent any subject matter disclosed in this non-provisional patent document conflicts with the priority application, the disclosure from this non-provisional patent document controls.

What is claimed:

1. A meter pit tile extension assembly comprising:

an inner ring that is attachable to a pit tile;

wherein the inner ring includes a first set of a plurality of outwardly extending ribs and a second set of a plurality of outwardly extending ribs spaced apart from the first set of the plurality of outwardly extending ribs;

wherein the plurality of outwardly extending ribs of the first set of the plurality of outwardly extending ribs are each located substantially parallel to each other;

wherein the plurality of outwardly extending ribs of the second set of the plurality of outwardly extending ribs are each located substantially parallel to each other;

a first space located between the first set of the plurality of outwardly extending ribs and the second set of the plurality of outwardly extending ribs;

a second space located between the second set of the plurality of outwardly extending ribs and the first set of the plurality of outwardly extending ribs;

wherein the second space is spaced apart from the first space;

an outer ring;

wherein the outer ring is telescopingly positioned over, and vertically movable with respect to, the inner ring;

wherein the outer ring includes a first set of a plurality of inwardly extending ribs and a second set of a plurality of inwardly extending ribs spaced apart from the first set of the plurality of inwardly extending ribs;

wherein the plurality of inwardly extending ribs of the first set of the plurality of inwardly extending ribs are each located substantially parallel to each other;

wherein the plurality of inwardly extending ribs of the second set of the plurality of inwardly extending ribs are each located substantially parallel to each other;

wherein the first set of the plurality of inwardly extending ribs of the outer ring are selectively positionable in a first position in the first space between the first set of the plurality of outwardly extending ribs and the second set of the plurality of outwardly extending ribs and the second set of the plurality of inwardly extending ribs is located in the second space between the second set of the plurality of outwardly extending ribs and the first set of the plurality of outwardly extending ribs;

wherein the outer ring is also rotatable with respect to the inner ring;

wherein rotation of the outer ring with respect to the inner ring causes the first set of the plurality of inwardly extending ribs and the second set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs and at least one inwardly extending rib of the second set of the plurality of inwardly extending ribs is selectively positionable adjacent at least one outwardly extending rib of the second set of the plurality of outwardly extending ribs;

a positive stop positioned adjacent at least one outwardly extending rib of the first set of the plurality of outwardly extending ribs is engageable with an inwardly extending rib of the first set of the plurality of inwardly extending ribs; and a stop tab positioned adjacent the at least one outwardly extending rib of the first set of the plurality of outwardly extending ribs and is spaced apart from the positive stop that is positioned adjacent the at least one outwardly extending rib of the first set of the plurality of outwardly extending ribs;

wherein the positive stop that is positioned adjacent the at least one outwardly extending rib of the first set of the plurality of outwardly extending ribs inhibits the outer ring from being rotated in a first direction; and wherein the stop tab that is positioned adjacent the at least one outwardly extending rib of the first set of the plurality of outwardly extending ribs inhibits the outer ring from being rotated in a second direction.

2. The meter pit tile extension assembly of claim 1, wherein the inner ring further comprises a positive stop that is positioned adjacent the at least one outwardly extending rib of the second set of the plurality of outwardly extending ribs and is engageable with an inwardly extending rib of the second set of the plurality of inwardly extending ribs, and a stop tab is positioned adjacent the at least one outwardly extending rib of the second set of the plurality of outwardly extending ribs and is spaced apart from the positive stop that is positioned adjacent the at least one outwardly extending rib of the second set of the plurality of outwardly extending ribs, wherein the positive stop that is positioned adjacent the at least one outwardly extending rib of the second set of the plurality of outwardly extending ribs inhibits the outer ring from being rotated in the first direction, and wherein the stop tab that is positioned adjacent the at least one outwardly extending rib of the second set of the plurality of outwardly extending ribs inhibits the outer ring from being rotated in the second direction.

3. The meter pit tile extension assembly of claim 2, wherein the inwardly extending rib of the second set of the plurality of inwardly extending ribs that is engageable with the positive stop is locatable adjacent the outwardly extending rib of the second set of the plurality of outwardly extending ribs between the positive stop and the stop tab.

4. The meter pit tile extension assembly of claim 2, wherein another inwardly extending rib of the second set of the plurality of inwardly extending ribs of the outer ring is locatable between a pair of outwardly extending ribs from the second set of the plurality of outwardly extending ribs of the inner ring.

5. The meter pit tile extension assembly of claim 2, wherein the positive stop that is positioned adjacent at least one outwardly extending rib of the second set of the plurality of outwardly extending ribs is resilient.

6. The meter pit tile extension assembly of claim 1, wherein the inner ring is configured to be attachable to an outer periphery of the pit tile.

7. The meter pit tile extension assembly of claim 1, wherein the inwardly extending rib of the first set of the plurality of inwardly extending ribs that is engageable with the positive stop is locatable adjacent the outwardly extending rib of the first set of the plurality of outwardly extending ribs between the positive stop and the stop tab.

8. The meter pit tile extension assembly of claim 1, wherein the stop tab prevents the outer ring from rotating more than about 90 degrees with respect to the inner ring.

9. The meter pit tile extension assembly of claim 1, wherein the second space located between the second set of the plurality of outwardly extending ribs and the first set of the plurality of outwardly extending ribs is positioned on an opposite side of the inner ring from the first space located between the first set of the plurality of outwardly extending ribs and the second set of the plurality of outwardly extending ribs.

10. The meter pit tile extension assembly of claim 1, wherein another inwardly extending rib of the first set of the plurality of inwardly extending ribs of the outer ring is locatable between a pair of outwardly extending ribs from the first set of the plurality of outwardly extending ribs of the inner ring.

11. The meter pit tile extension assembly of claim 1, wherein the positive stop that is positioned adjacent at least one outwardly extending rib of the first set of the plurality of outwardly extending ribs is resilient.

12. The meter pit tile extension assembly of claim 1, wherein the outer ring that is vertically movable with respect to the inner ring does not use helical threads to translate rotational movement into linear movement to be vertically movable.

13. The meter pit tile extension assembly of claim 1, wherein the at least one outwardly extending rib of the first set of the plurality of outwardly extending ribs includes a chamfered edge located adjacent the positive stop.

14. The meter pit tile extension assembly of claim 1, wherein neither the first nor second sets of the plurality of outwardly extending ribs on the inner ring encircle an entire circumference of the inner ring.

15. The meter pit tile extension assembly of claim 1, wherein neither the first nor second sets of the plurality of inwardly extending ribs on the outer ring encircle an entire circumference of the outer ring.

16. A meter pit tile extension assembly comprising:

an inner ring that is attachable to a pit tile;

wherein the inner ring includes a first set of a plurality of outwardly extending ribs and a second set of a plurality of outwardly extending ribs spaced apart from the first set of the plurality of outwardly extending ribs;

wherein the plurality of outwardly extending ribs of the first set of the plurality of outwardly extending ribs are each located substantially parallel to each other;

wherein the plurality of outwardly extending ribs of the second set of the plurality of outwardly extending ribs are each located substantially parallel to each other; and an outer ring;

wherein the outer ring is telescopingly positioned over, and vertically movable with respect to, the inner ring;

wherein the outer ring includes a first set of a plurality of inwardly extending ribs and a second set of a plurality of inwardly extending ribs spaced apart from the first set of the plurality of inwardly extending ribs;

wherein the plurality of inwardly extending ribs of the first set of the plurality of inwardly extending ribs are each located substantially parallel to each other;

wherein the plurality of inwardly extending ribs of the second set of the plurality of inwardly extending ribs are each located substantially parallel to each other;

wherein the outer ring is also rotatable with respect to the inner ring; and wherein rotation of the outer ring with respect to the inner ring causes the first set of the plurality of inwardly extending ribs and the second set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs and at least one inwardly extending rib of the second set of the plurality of inwardly extending ribs is selectively positionable adjacent at least one outwardly extending rib of the second set of the plurality of outwardly extending ribs; and wherein the outer ring that is vertically movable with respect to the inner ring does not use helical threads to translate rotational movement into linear movement to be vertically movable.

17. The meter pit tile extension assembly of claim 16, wherein the inner ring includes a first space located between the first set of the plurality of outwardly extending ribs and the second set of the plurality of outwardly extending ribs, and a second space located between the second set of the plurality of outwardly extending ribs and the first set of the plurality of outwardly extending ribs, wherein the second space is spaced apart from the first space.

18. The meter pit tile extension assembly of claim 17, wherein the first set of the plurality of inwardly extending ribs of the outer ring are selectively positionable in a first position in the first space between the first set of the plurality of outwardly extending ribs and the second set of the plurality of outwardly extending ribs and the second set of the plurality of inwardly extending ribs is located in the second space between the second set of the plurality of outwardly extending ribs and the first set of the plurality of outwardly extending ribs.

19. The meter pit tile extension assembly of claim 18, wherein the inner ring further includes a positive stop positioned adjacent at least one outwardly extending rib of the first set of the plurality of outwardly extending ribs and is engageable with an inwardly extending rib of the first set of the plurality of inwardly extending ribs, and a stop tab positioned adjacent the at least one outwardly extending rib of the first set of the plurality of outwardly extending ribs and is spaced apart from the positive stop that is positioned adjacent the at least one outwardly extending rib of the first set of the plurality of outwardly extending ribs, wherein the positive stop that is positioned adjacent the at least one outwardly extending rib of the first set of the plurality of outwardly extending ribs inhibits the outer ring from being rotated in a first direction; and wherein the stop tab that is positioned adjacent the at least one outwardly extending rib of the first set of the plurality of outwardly extending ribs inhibits the outer ring from being rotated in a second direction.

20. A meter pit tile extension assembly comprising:

an inner ring that is attachable to a pit tile;

wherein the inner ring includes a first set of a plurality of outwardly extending ribs;

wherein the plurality of outwardly extending ribs of the first set of the plurality of outwardly extending ribs are each located substantially parallel to each other;

a first space located adjacent the first set of the plurality of outwardly extending ribs;

an outer ring;

wherein the outer ring is telescopingly positioned over, and vertically movable with respect to, the inner ring;

wherein the outer ring includes a first set of a plurality of inwardly extending ribs;

wherein the plurality of inwardly extending ribs of the first set of the plurality of inwardly extending ribs are each located substantially parallel to each other;

wherein the first set of the plurality of inwardly extending ribs of the outer ring are selectively positionable in a first position in the first space between the first set of the plurality of outwardly extending ribs;

wherein the outer ring is also rotatable with respect to the inner ring; and wherein rotation of the outer ring with respect to the inner ring causes the first set of the plurality of inwardly extending ribs to be selectively positionable in a second position such that at least one inwardly extending rib of the first set of the plurality of inwardly extending ribs is selectively positionable adjacent at least one outwardly extending rib of the first set of the plurality of outwardly extending ribs; and wherein the outer ring that is vertically movable with respect to the inner ring does not use helical threads to translate rotational movement into linear movement to be vertically movable.

* * * * *